United States Patent [19]

Shiibayashi

[11] Patent Number: 4,494,914

[45] Date of Patent: Jan. 22, 1985

[54] SCROLL FLUID APPARATUS WITH DISPLACED CENTERS FOR THE SCROLL MEMBER END PLATES

[75] Inventor: Masao Shiibayashi, Shimizu, Japan

[73] Assignee: Hitachi, Ltd., Tokyo, Japan

[21] Appl. No.: 481,151

[22] Filed: Apr. 1, 1983

[51] Int. Cl.[3] ..... F01C 1/02

[52] U.S. Cl. ..... 418/55

[58] Field of Search ..... 418/55

[56] References Cited

U.S. PATENT DOCUMENTS 3,884,599 5/1975 Young et al. ..... 418/55

FOREIGN PATENT DOCUMENTS 55-51986 4/1980 Japan .

55-51987 4/1980 Japan .

56-20701 2/1981 Japan ..... 418/55

*Primary Examiner*—John J. Vrablik

*Attorney, Agent, or Firm*—Antonelli, Terry & Wands

[57] ABSTRACT

A scroll fluid apparatus including a stationary scroll member having an end plate of a disc shape and a spiral wrap disposed in upright position on the end plate and formed with a suction chamber defined by an arcuate wall of an outer peripheral portion of the wrap, and an orbiting scroll member having an end plate of a disc shape and a spiral wrap disposed in upright position on the end plate. The stationary scroll member and the orbiting scroll member mesh with each other to allow the orbiting scroll member to move in orbiting movement with respect to the stationary scroll member. The stationary member is formed with an exhaust port opening and a suction port so that gas is drawn by suction through the suction port and compressed in compression spaces defined by the two scroll members to thereby be discharged as compressed gas through the exhaust port. The orbiting scroll member and the stationary scroll member have the centers of their disc-shaped end plates displaced from the centers of base circles of the respective spiral wraps toward outer end edge portions of the wrap by $\pi a/2$ where $\pi$ is the ratio of the circumference of a circle to its diameter and a is the radius of the base circles of the spiral wraps.

10 Claims, 15 Drawing Figures

SCROLL FLUID APPARATUS WITH DISPLACED CENTERS FOR THE SCROLL MEMBER END PLATES

BACKGROUND OF THE INVENTION

This invention relates to scroll fluid apparatus suitable for use for refrigerating apparatus, air compressors or expanders.

Generally a scroll fluid apparatus comprises an orbiting scroll member and a fixed or stationary scroll member, with the orbiting scroll member including an end plate and a wrap in the form of an involute curve or the like disposed in an upright position on the end plate, and the stationary scroll member including an end plate and a wrap in the form of an involute curve or the like disposed in an upright position on the end plate and formed with an exhuast port near the center of the end plate and with a suction port at an outer portion of the end plate, the orbiting and the stationary scroll members being assembled with the wraps facing inwardly and meshing with each other and contained in a casing having a suction pipe and a discharge pipe both connected to the casing.

A scroll fluid apparatus of the aforementioned type is disclosed in, for example, U.S. Pat. No. 3,884,559, wherein an Oldham'coupling mechanism is mounted between the orbiting scroll member and a frame or between the orbiting scroll member and the stationary scroll member to keep the oribiting scroll member from rotating on its own axis, and the oribiting scroll member is kept in engagement with a crankshaft which moves the oribiting scroll member in orbiting movement without rotating on its own axis to compress gas in sealed spaces defined between the two scroll members and discharge compressed gas through the exhaust port.

In a scroll fluid apparatus of the aforementioned type, one of the sealed spaces is defined by an inner wall surface of the wrap of the stationary scroll member, an outer wall surface of the wrap of the orbiting scroll member and end surfaces of the end plates of the two scroll members, and the other sealed space is defined by an outer wall surface of the wrap of the stationary scroll member, an inner wall surface of the orbiting scroll member and the end surfaces of the end plates of the two scroll members, so that the two sealed spaces can be symmetrical. Thus, two suction chambers are formed before the two sealed spaces are formed and each have a suction passage connected to the suction port. It is essential that these suction passages each have a predetermined passage area. If the passage areas of the suction passages were reduced, the suction pressure would suffer a loss of pressure and a variation in pressure. Also, if the two suction passages are inordinately distinct from each other in the area of passage, the loss of pressure and the variation in pressure would differ from one suction passage to the other suction passage. The result of this would be that pressure difference would be produced between the two sealed space in the same compression stroke and cause a leak to occur between the two chambers, thereby increasing power required for operating the compressor.

It is generally desired that an overall compact size and a light weight be obtained in this type of scroll fluid apparatus. The compressor section of a fluid scroll apparatus is composed of the orbiting and the stationary scroll members which are circular at the outer periphery, so that is is possible to reduce the size of the apparatus by reducing the diameter of the end plates which are in the form of a disc.

Japanese Patent application Laid-Open No. 51986/80 and No. 51987/80, both relate to a scroll fluid apparatu in which the end plate of the orbiting scroll member is off-center, to reduce the diameter of the casing. More specifically, the end plate of the orbiting scroll member has a diameter $2r+R$, wherein r is the distance between the center of the base circle of the spiral wrap and the outermost end of the spiral wrap, and R is the length of a crank arm, and the center of the end plate of the oribiting scroll member is displaced by R/2 from the center of the base circle of the spiral wrap in a direction opposite the direction of the outermost end of the spiral wrap from the center of the base circle, while the center of the housing is displaced by R/2 from the centers of the base circles of the spiral wraps of the scroll members in the direction of the outermost end of the spiral wraps, to thereby reduce the diameter of the housing. However, no express mention is made in the Japanese applications with regard to obtaining a predetermined area required for the suction passages.

SUMMARY OF THE INVENTION

An object of this invention is to provide a scroll fluid apparatus wherein two suction passages communicating with two suction chambers defined by the orbiting scroll member and the stationary scroll member have substantially the same area which is essentially large enough to minimize a loss of pressure and a variation in pressure which might be caused to occur by a reduction in the area of the suction passages, thereby improving the performance of the scroll fluid apparatus.

Another object is to provide a scroll fluid apparatus in which internal leaks between the symmetrical sealed spaces can be avoided.

Still another object is to provide a scroll fluid apparatus in which the diameter of its compressor section is reduced, to enable an overall compact size and a light weight to be obtained in a scroll fluid apparatus.

The aforesaid objects are accomplished according to the invention by providing a scroll fluid apparatus comprising a stationary scroll member, including an end plate of a disc shape and a wrap of a spiral form disposed in upright position on the end plate and having a suction chamber formed by an arcuate wall of an outer peripheral portion of the wrap, and an orbiting scroll member including an end plate of a disc shape and a wrap of a spiral form disposed in upright position on the end plate, with the stationary scroll member and the orbiting scroll member being assembled with the wraps facing inwardly and meshing with each other to allow the orbiting scroll member to move in orbiting movement with respect to the stationary scroll member without rotating on its own axis. The stationary scroll member is formed with an exhaust port opening in a central portion of the end plate and a suction port opening at its outer peripheral portion so that gas is drawn by suction through the suction port and compressed in compression chambers defined by the two scroll members and shifting the position to have the volume reduced to thereby discharge compressed gas through the exhaust port. The orbiting scroll member and the stationary scroll member have the centers of their end plates of the disc shape displaced from the centers of base circles of the respective spiral wraps toward outer end edge portions of the wraps by $\pi a/2$ where $\pi$ is the ratio of the circumference of a circle to its diameter, and a is the radius of the base circles of the spiral wraps.

By rendering the centers of the end plates off-center, it is possible to increase the distance between the outer end edge portion of the spiral wrap and an outer edge of the end plate spaced radially therefrom, to thereby increase the area of a suction passage formed outside the outer end edge portion of the wrap. Thus it is possible to increase the distancem that is, the width of the suction passage, between the outer end edge portion of the spiral wrap and an arcuate wall surface of a suction chamber formed at an outer peripheral portion of the stationary scroll member. Due to the fact that the area of the suction passage at the outer end edge portion of the wrap can be increased as described hereinabove, it is possible to give substantially the same area to another suction passage formed in a position spaced apart circumferentially from the outer end edge portion of the wrap by a distance corresponding to an extent of substantially 180 degrees of wrap winding angle, to thereby minimize a loss of pressure and a variation in pressure occurring in the suction pressure. Also, it is possible to eliminate internal leaks between symmetrically disposed sealed spaced by avoiding the occurrence of a difference in pressure between two suction spaces immediately before compression. This is conducive to improved volume efficiency and reduced power required for operating the compressor, thereby improving overall adiabatic efficiency.

According to the invention it is possible to obtain an overall compact size and a light weight in a scroll fluid apparatus, because the diameter of the scroll members can be reduced by ($\pi$a) at a maximum by virtue of the arrangement that the centers of the end plates are displaced from the centers of base circles of the spiral wraps by a constant value ($\pi$a/2).

DETAILED DESCRIPTION

Figure 1:
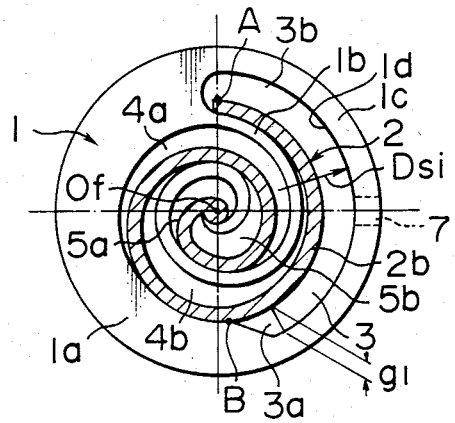
FIG. 1 PRIOR ART
FIG. 1 is a transverse cross-sectional view of a stationary scroll member and an orbiting scroll member in meshing engagement with each other while performing compression of a conventional scroll fluid apparatus.
Figure 2:
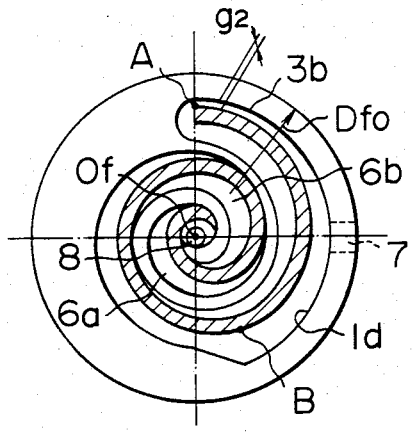
FIG. 2 PRIOR ART
FIG. 2 is a transverse cross-sectional view of the orbiting scroll member of FIG. 1 shifted in orbiting movement from the position shown in FIG. 1.

As shown in FIGS. 1 and 2, in a conventional scroll fluid apparatus a stationary scroll member generally designated by the reference numeral 1 and the conventional orbiting scroll member generally designated by the reference numeral 2, having the centers of their end plates in agreement with the centers of the base circles of the respective wraps, are in meshing engagement with each other while performing compression. The stationary scroll member 1 and the orbiting scroll member 2 have end plates 1*a* and 2*a* of a disc shape, and spiral wraps 1*b* and 2*b* of an involute curve disposed in upright position on the end plates 1*a* and 2*a*, respectively. The two scroll members 1 and 2 are assembled together with the respective spiral wraps 1*b* and 2*b* facing inwardly and maintained in meshing engagement with each other.

Sealed spaces 4*a*–5*a* are defined by an inner wall surface of the stationary scroll wrap 1*b*, an outer wall surface of the orbiting scroll wrap 2*b*, and end surfaces of the end plate 1*a* and 2*a* of the two scroll member 1 and 2, for example. At the same time, sealed spaces 4*b* and 5*b* are defined, for example by an outer wall surface of the stationary scroll wrap 1*b*, an inner wall surface of the orbiting scroll wrap 2*b* and the end surfaces of the end plates 1*a* and 2*a*. These sealed spaces constitute two sealed spaces which are symetrically disposed. Thus, a suction chamber 3 of the scroll fluid apparatus is capable of communicating with the outermost sealed spaces 4*a* and 4*b* has two suction passages 3*a* and 3*b* leading thereto. The suction chamber 3 is defined by an outermost wall surface 1*d* of a groove of the stationary scroll wrap 1*b* on the stationary scroll member 1, with the wall surface 1*d* being of circularly arcuate shape. When the scroll fluid apparatus is used as a compressor for refirgeration, a refrigerant in a gaseous state of low temperature and low pressure is drawn by suction through a suction port 7 formed at an outer peripheral portion 1*c* of the end plate 1*a* of the stationary scroll member 1 into a suction chamber 3 defined outwardly of an outer peripheral portion of the orbiting scroll member 2. FIG. 1 shows the two scroll members 1 and 2 disposed in the respective working positions when the suction operation is completed.

The orbiting scroll member 2 then moves in orbiting movement in which it is kept from rotating on its own axis by an Oldham's coupling mechanism, not shown, so that the volumes of the sealed spaces formed by the two scroll members 1 and 2 are gradually reduced and the refrigerant gas, drawn into the sealed spaces 4*a* and 4*b*, shifts its position toward the central portions of the two scroll members 1 and 2 while having temperature and pressure thereof rise, before the gas is discharged through a center exhaust port 8.

As shown in FIG. 1, the suction passage 3*a* is kept in a condition in which it has a substantially large area. However, the other suction passage 3*b*, in which an outer end edge portion of the stationary scroll wrap 1*b* and an outer edge portion A of the orbiting scroll wrap 2*b* mesh with each other, has its area increased and decreased repeatedly as the orbiting scroll member 2 moves in an orbiting movement.

Thus, when the suction passage 3*b* is reduced in area as shown in FIG. 2, a loss of pressure would occur. When thee suction passage 3*a* and 3*b* are respectively reduced in area the passages 3*a*, 3*b* have gaps $g_1$ and $g_2$, respectively, as shown in FIGS. 1 and 2. The outermost wall surface 1*d* of the groove of the stationary scroll wrap 1*b* constituting the suction chamber 3 including the suction passages 3*a* and 3*b* is circularly arcuate in shape and is centered at the center of the end plate 1*a* which agrees with the center Of of the base circle of the stationary scroll wrap 1*b*. In this construction, the dimension $D_{si}$ (FIG. 1) of the outermost wall surface 1*d* of the groove constituting the suction chamber 3 is determined by the folowing equation:

$$D_{si}=2(a\lambda_l+\epsilon+g_2) \quad (1)$$

where $D_{si}$=inner diameter of suction chamber 3.

a=radius of base circle of scroll wrap.

$\lambda_l$=terminating winding angle of scroll wrap (involute angle).

$\epsilon$=radius of orbiting movement.

$g_2$=minimum gap between acuate wall surface 1*d* and orbiting scroll wrap side wall.

The shape of the suction chamber 3 or the outer diameter $D_{f0}$ of the stationary scroll member 1 can be obtained from equation (1). Thus, when the profile (dimensions a, $\lambda_l$ and $\epsilon$ of equation (1), for example) of the scroll wrap is determined, it would follow that $g_2$ of equation (1) should have its value reduced if it is desired to reduce the overall size of the stationary scroll member 1 (the dimension $D_{f0}$ shown in FIG. 3). However, if the value of $g_2$ is reduced, the problem that a loss of pressure increases in the suction passage 3*b* would be raised, thereby adversely affecting the performance of the scroll fluid apparatus.

Figure 3:
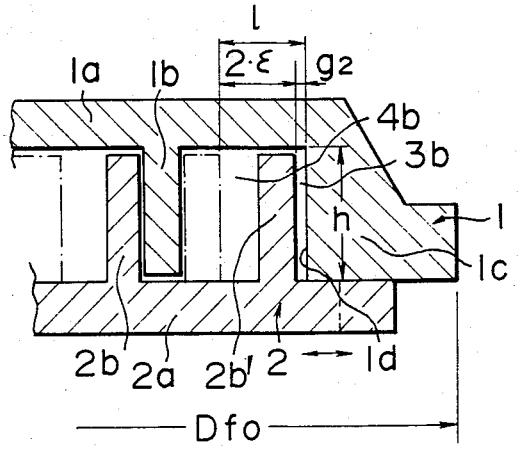
FIG. 3 PRIOR ART
FIG. 3 is a vertical cross sectional view, on an enlarged scale, of the two scroll members of FIG. 1 in meshing engagement with each other.

As shown in FIG. 3, the suction passage 3*b* between a side wall surface of an outer edge portion 2*b'* *of the orbiting scroll wrap 2b* and a side wall surface of the outer peripheral portion 1*c* of the stationary scroll member 1 undergoes a change in size as the orbiting scroll member 2 moves in orbiting movement. Using the minimum gap $g_2$, a maximum gap l can be obtained from the following equation:

$$l=g_2+2\epsilon \quad (2)$$

where $\epsilon$=radius of orbiting movement.

Thus, the area of the suction passage can be obtained by multiplying the gap described hereinabove by the height h of the scroll wraps. The area of the suction passage 3*b* also undergoes a change in value as the orbiting scroll member 2 moves in orbiting movement, in the same manner as described hereinabove in the connection with the gap. Meanwhile, in the suction passage 3*a*, the gap, the minimum value of which is $g_1$, constituting the suction passage, can be kept at a large value at all times regardless of the orbiting movement of the orbiting scroll member 2.

The difference between the minimum gaps $g_1$ and $g_2$ of the suction passages 3*a*, 3*b* arises from the fact that the stationary scroll member 1 is constructed, as shown in FIG. 1, to have the center of the arcuate surface 1*d* of the suction chamber 3 in agreement with the center $O_f$ of the base circle of the wrap 1*b*. In the conventional scroll apparatus, the center of the end plate 1*a*, the center $O_f$ of the base circle of the wrap 1*b* and the center of the arcuate surface 1*d* of the suction chamber 3 are ordinarily in agreement with one another as shown in FIG. 1. Furthermore, in the orbiting scroll member 2, the center of the end plate 2*a* is in agreement with the center $O_m$ of the base circle of the wrap 2*b*.

Figure 4:
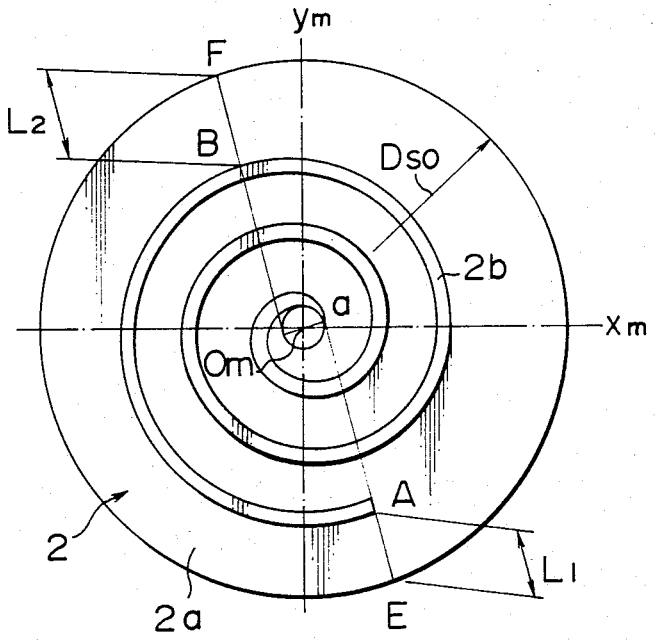
FIG. 4 PRIOR ART
FIG. 4 is a plan view of the orbiting scroll member of FIG. 1.

Let the outer diameter of the end plate 2*a* of the orbiting scroll member 2, the radius of the base circle of the orbiting scroll wrap 2*b* and the winding angle of the orbiting scroll wrap 2*b* (which is the involute angle when the scroll wrap is an involute curve) be denoted by $D_{so}$, a and $\lambda_l$, respectively, as shown in FIG. 4. Then, with the ratio of the circumference of a circle to its diameter being $\pi$, the distance $L_1$ between a point A at the outer end edge portion of the wrap 2*b* and a point E at the outer peripheral edge of the end plate 2*a* and the distance $L_2$ between a point B, circumferencially displaced from point A by an extent of 180 degrees and a point F at the outer peripheral edge of the end plate 2*a*, can be expressed by the following equations:

$$L_l=(D_{so}/2)-a\cdot\lambda_l \quad (3)$$

$$L_2=(D_{so}/2-a\cdot(\lambda_l-\pi) \quad (4)$$

The following equation can obtained from equations (3) and (4):

$$L_2=L_1+a\pi \quad (5)$$

As shown in FIGS. 1 and 2, point A at the outer end edge portion of the orbiting scroll wrap 2*b* and point B, substantially symmetrical with point A are located at the suction passages 3*a* and 3*b*, respectively. Thus, the difference between the minimum gap $g_1$ of the suction passage 3*a* and the minimum gap $g_2$ of the suction passage 3*b* can be essentially expressed as the difference between the distances $L_1$ and $L_2$ as shown in equation (5).

Expressing the dimensions $D_{si}$ by utilizing $g_1$, the following equation (1)' is obtained:

$$D_{si}=2\{a(\lambda_l-\pi)+\epsilon+g_l\} \quad (1)'$$

from the equations (1) and (1)' the difference between the gaps $g_1$ and $g_2$ is readily obtained to a high.

When the differences between the gaps $g_1$ and $g_2$ is denoted by $\Delta g$, $\Delta g$ can be expressed by the following equation:

$$\Delta g=g_1-g_2=L_2-L_1=a\pi \quad (6)$$

In a conventional compression mechanism in which the centers of the end plates 1*a* and 2*a* of the stationary and the orbiting scroll members 1 and 2 agree with the centers of the base circles of the wraps 1*b* and 2*b*, respectively, the gaps $g_1$ and $g_2$ formed at the suction passages 3*a* and 3*b*, respectively, would be distinct from each other in value. Due to this difference, in addition to the fact that a flow of refrigerant gas toward the suction passages 3*a* and 3*b* would cause a friction loss to occur between the refrigerant gas and the wall surfaces of the suction passages, a change in the area of passages, caused by the orbiting movement of the orbiting scroll member and a change in configuration, such as curving, would cause a loss and a change in pressure to occur.

If the gap $g_2$ of the suction passage 3b is inordinately smaller in value than the gap $g_1$ of the suction passage 3a, a loss and a change in pressure in this portion would be high. Thus, a reduction in the volume efficiency of the compressor might cause a reduction in performance.

Moreover, the difference in area between the suction passages 3a and 3b would cause a variation to occur in the loss and change in pressure between the suction passages 3a and 3b. This would cause a variation to occur in the pressure of refrigerant gas immediately before compression, and a pressure difference would occur between, for example, a pair of compression chambers, such as the sealed spaces 4a and 4b and 5a and 5b. Such pressure difference would increase leaks, so that the power required for operating the compressor would increase and the overall adiabatic efficiency would drop. The loss of pressure occurring in the suction passages described hereinabove would become marked as the compressor is operated at high speeds. Thus, an increase in the number of revolutions of the compressor might cause a marked reduction in performance.

Figure 5:
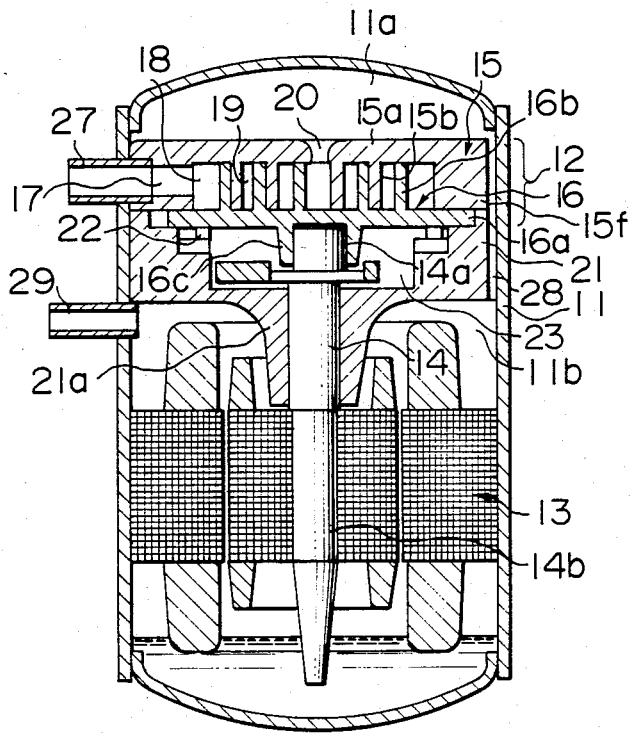
FIG. 5 is a vertical cross-sectional view of a scroll fluid apparatus constructed in accordance with the present invention.

As shown in FIG. 5, the scroll fluid apparatus, operating as a compressor, includes a compressor section 12 having a stationary scroll member generally designated by the reference numeral 15 and an orbiting scroll member generally designated by the reference numeral 16 in meshing engagement with each other to define compression chambers (sealed spaces) 19. The stationary scroll member 15 includes a disc-shaped end plate 15a, a wrap 15b of an involute curve disposed in upright position on the end plate 15a, an exhaust port 20 in a central portion thereof and a suction port 17 at an outer peripheral portion thereof. The orbiting scroll member 16 includes a disc-shaped end plate 16a a wrap 16b of an involute curve disposed in upright position on the end plate 16a, and a boss 16c on a surface of the end plate 16a opposite the surface on which the wrap 16b is disposed.

A frame 21 has a central portion thereof formed with a bearing section 21a for journaling a crankshaft 14 having a crank pin 14a at a forward end thereof inserted in the boss 16c for orbital movement. The stationary scroll member 15 is secured to the frame 21 by a plurality of bolts, and the orbiting scroll member 16 is supported by the frame 21 through an Oldham's coupling mechanism 22 including an Oldham's ring and an Oldham's key, so that the orbiting scroll member 16 can move in orbiting movement with respect to the stationary scroll member 15 without rotating on its own axis.

The crankshaft 14 has its lower portion connected unitarily to a motor shaft 14b for connecting the compressor section 12 direct to the motor section 13.

The suction port 17 of the stationary scroll member 15 is connected to a suction pipe 27 penetrating a wall of the sealed container 11, and the exhaust port 20 opens in an exhaust chamber 11a communicating through a passage 28 with a lower chamber 11b which is communicating with a discharge pipe 29 penetrating the wall of the sealed container 11.

Rotation of the crankshaft 14, directly connected to the motor section 13, causes the crank pin 14a to eccentrically rotate, to thereby cause the orbiting scroll member 16 to move in orbiting movement through the boss 16c. As the orbiting scroll member 16 moves in orbiting movement, the compression chambers 19 successively shift the position toward the center of the end plate 16a while reducing the volume. Gas flows through the suction pipe 27 and the suction port 17 into a suction chamber 18, to be discharged into the exhaust chamber 11a through the exhaust port 20 after being compressed.

From the exhaust chamber 11a, the compressed gas flows through the passage 28 into the lower chamber 11b from which it is discharged through the exhaust pipe 29. As shown most clearly in FIGS. 6 and 7, the orbiting scroll member 16 includes the disc-shaped end plate 16a, and the spiral wrap 16b disposed in upright position on the end plate 16a. The center Om' of the end plate 16a is displaced from the center Om of a base circle 30 of the wrap 16b toward point A positioned at the outer end edge portion of the wrap 16b by a predetermined distance $\pi a/2$ where $\pi$ is the ratio of the circumference of a circle to its diameter, and a is the radius of the base circle 30 of the wrap 16b. *Assuming the axes of coordinates of the center Om of the base circle 30 and the center Om' of the end plate 16a* are denoted by Xm, Ym, and Xm', Ym' respectively, the predetermined displacement OmOm' can be expressed by the following equation:

$$OmOm' = (\pi a/2) \tag{7}$$

The displacement or distance OmOm' is half the distance expressed by equation (6).

By displacing the center of the end plate 16a from the center Om of the base circle 30 of the wrap 16b to Om', it is possible to render the distance Om'A from the center Om' of the end plate 16a to point A at the outer end edge portion of the wrap 16b equal to the distance Om'B from the center Om' of the end plate 16a to point B circumferencially spaced apart from point A by an extent of 180 degrees. Meanwhile, in the end plate 16a of the outer diameter $D_{so}'$, the distance between point A at the outer end edge portion of the wrap 16b and point E at the outer peripheral edge of the end plate 16a and the distance between point B and point F at the outer peripheral edge of the end plate 16a have the same distance $L_3$.

By setting the distance $L_3$, hereinafter called land width, $L_3$ between point A at the outer end edge portion of the wrap 16b of the orbiting scroll member 16 and the outer peripheral edge of the end plate 16a located outwardly thereof at a value equal to the land width $L_3$ at the point B, it is possible to cause uniform wear on the end plate 16a of the orbiting scroll member 16 and possible to obtain a uniform sealing function. As shown in FIG. 5, an end surface of an outer peripheral portion 15f of the end plate 15a of the stationary scroll member 15 is maintained in sliding contact with an outer peripheral surface of the end plate 16a of the orbiting scroll member in juxtaposed relationship thereto, to provide a seal between the suction chamber 18 and a space 23 below an under surface of the end plate 16a of the orbiting scroll member 16.

Figure 8:
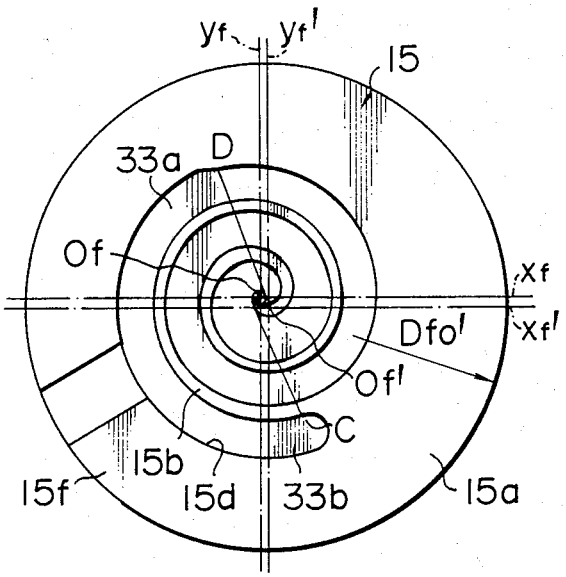
FIG. 8 is a plan view of the stationary scroll member of the apparatus of FIG. 5.
Figure 9:
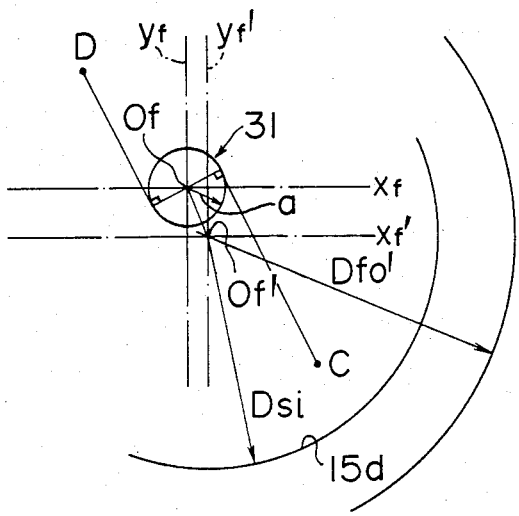
FIG. 9 is a fragmentary schematic view illustrating the relationship between the axes of coordinates of the stationary scroll member of FIG. 8 and a base circle.

As shown in FIGS. 8 and 9, the stationary scroll member 15 includes the disc-shaped end plate 15a, and the spiral wrap 15b disposed in upright position on the end plate 15a. The center Of' of the end plate 15a is displaced from the center Of of a base circle 31 of the wrap 15b toward a point C positioned at an outer peripheral portion of the wrap 15b by a distance corresponding to the displacement of the center Om' of the end plate 16a of the orbiting scroll member 16. Assuming the axes of coordinates of the center Of of the base circle 31 and the center Of' of the end plate 15b be denoted by Xf, Yf and Xf', Yf' respectively, the displacement or distance OfOf' of the center Of' is equal to the displacement or distance OmOm' of the center Om' of the end plate 16a of the orbiting scroll member 16, which is equal to $\pi a/2$.

By displacing the centers Of' and Om' of the end plates 15a and 16a of the stationary and the orbiting scroll members 15 and 16 from the centers Of and Om of the base circles 30 and 31 of the wraps 15b and 16b, respectively, by the aforesaid predetermined distance $\pi a/2$, it is possible to render the gaps formed at suction passages 33a and 33b, corresponding to the suction passages 3a and 3b shown in FIG. 1, equal to each other in value. Also, by setting the dimension $D_{si}$, forming the suction chamber, of a peripheral wall surface of the outer peripheral portion 15f of the stationary scroll member 15 or an arcuate wall surface 15d of an outermost peripheral groove of the stationary scroll member 15 at a value equal to the value of the corresponding portion of the stationary scroll member 1 shown in FIG. 1, it is possible to increase the area of the suction passage 33b by the distance OfOf' over that of the suction passage 3b (FIG. 1). The arcuate wall surface 15d of the outermost peripheral groove of the stationary scroll member 15 is centered at the center Of' of the end plate 15a.

In accordance with the invention, it is possible to reduce the outer diameter of the end plate 16a of the orbiting scroll member 16 by ($\pi$ a) at a maximum as compared with that of the prior art, if the center of the end plate 16a is displaced by the predetermined distance $\pi a/2$ from the center Om of the base circle 30 of the wrap 16b. Assuming the outer diameter of the end plate 16a of the orbiting scroll member 16 in FIGS. 6 and 7 and the outer diameter of the end plate shown in FIG. 4 are denoted by $D_{so}'$ and $D_{so}$ respectively, and assuming that $L_1=L_3$, the outer diameter $D_{so}'$ can be expressed by the following equation:

$$D_{so}'=2(a\cdot\lambda_l-\pi a/2+L_3)=D_{so}-\pi a \quad (8)$$

Figure 6:
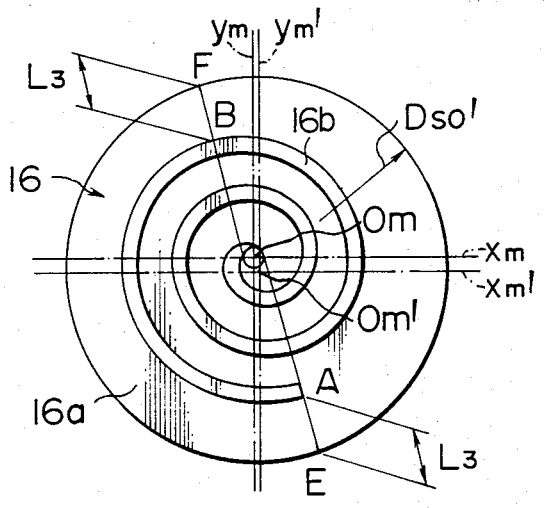
FIG. 6 is a plan view of the orbiting scroll member of FIG. 5.
Figure 7:
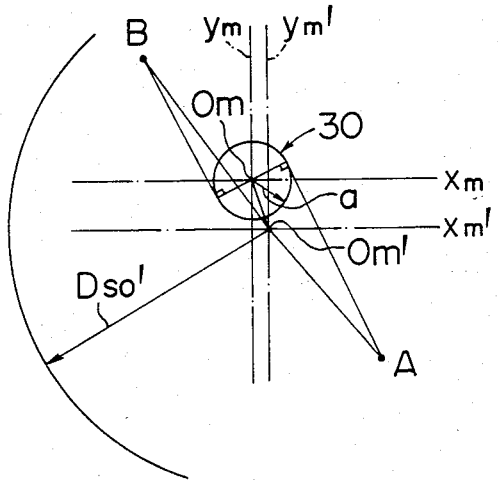
FIG. 7 is a fragmentary schematic view illustrating a relationship between the axes of coordinates of the orbiting scroll member shown in FIG. 6 and a base circle.

In FIGS. 8 and 9, the outer diameter of the end plate 15a of the stationary scroll member 15 can be reduced in the same manner as described hereinabove by referring to the orbiting scroll member 16 shown in FIGS. 6 and 7.

Thus, it will be apparent that the scroll compressor according to the invention can have its outer diamter reduced by ($\pi$ a) at a maximum extent as compared with the compressor shown in FIG. 1 in which the center of the end plate of each scroll member coincides with the center of the base circle of its wrap. Assuming the outer diameters of the end plates shown in FIGS. 8 and 2 be denoted by $D_{fo}'$ and $D_{fo}$, respectively. Then $D_{fo}'$ can be expressed by the following equation:

$$D_{fo}'=D_{fo}-\pi a \quad (9)$$

Figure 10:
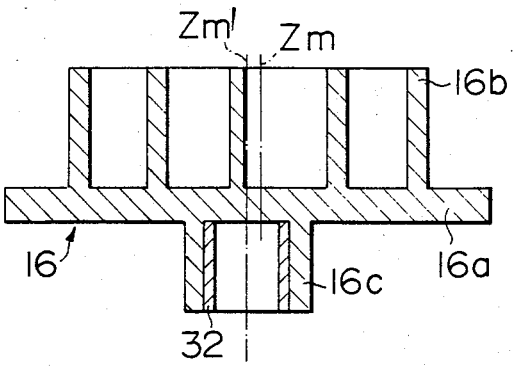
FIG. 10 is a vertical cross-sectional view, on an enlarged scale, of te orbiting scroll member of FIG. 5.

In FIG. 10, Zm and Zm' designate vertical axes of coordinates of the orbiting scroll member 16 extending through the centers Om and Om' (FIG. 7) of the base circle 30 of the scroll wrap 16b and the end plate 16a, respectively. The end plate 16a has at a bottom surface thereof the orbiting boss 16c for supporting an orbiting bearing 32 whose center axis is in alignment with the center axis Zm' of the end plate 16a. By bringing centers of the orbiting boss 16c and the end plate 16a and the end plate 16a into agreement with one another, it is possible to reduce an unbalanced force produced in the end plate 16a by the orbiting movement of the orbiting scroll member 16.

Figure 11:
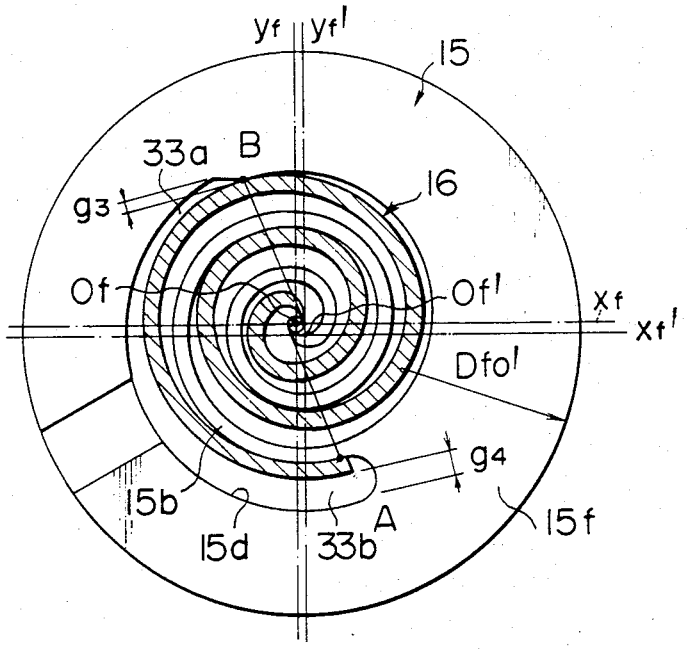
FIG. 11 is a transverse cross-sectional view of the stationary scroll member and the orbiting scroll member of the apparatus of FIG. 5 in meshing engagement with each other while performing compression.

FIG. 11 shows the two scroll members 15 and 16 relative to each other in a condition in which they have completed a suction stroke. Gaps of the suction passages 33a and 33b formed at this time are denoted by $g_3$ and $g_4$, respectively. In this embodiment, the gap $g_3$ is smaller than the gap $g_4$ by $2\epsilon$.

Figure 12:
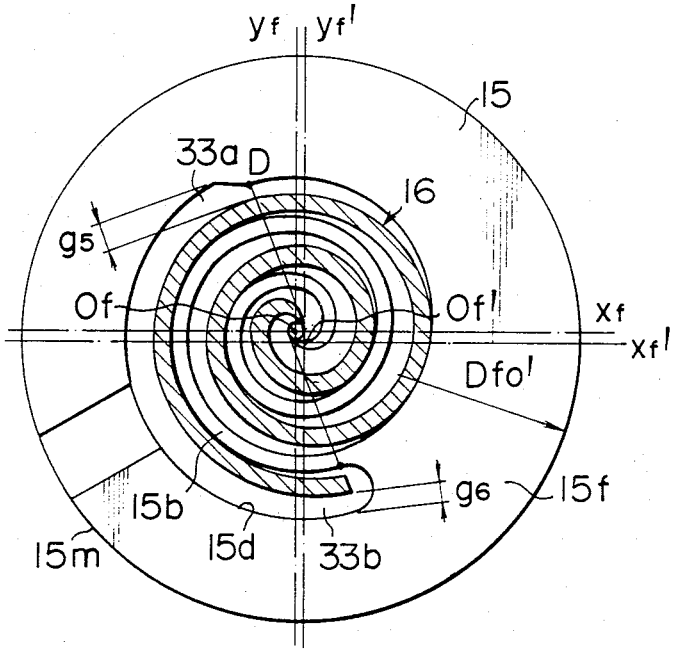
FIG. 12 is a transverse cross-sectional view of the orbiting scroll member shifted in orbiting movement from the position shown in FIG. 11.

In FIG. 12, the gaps of the suction passages 33a and 33b formed are respectively denoted by $g_5$, $g_6$, with the gap $g_5$ being larger than the gap $g_6$ by $2\epsilon$. Since the centers of the end plates of the stationary and the orbiting scroll members 15 and 16 are displaced, as described hereinabove, from the centers of the base circles of the wraps 15b and 16b of the spiral respectively form toward the outer end edge portions of the wraps by the predetermined distance $\pi a/2$, it is possible to render the gaps $g_3$ (FIG. 11) and $g_6$ (FIG. 12) are substantially equal to each other. Namely, the minimum gap $g_3$ of the suction passage 33a becomes substantially equal to the minimum gap $g_6$ of the suction passage 33b. The arcuate wall surface 15d of the outermost peripheral groove of the stationary scroll 15 forming the suction chamber and an outer peripheral edge 15m of the end plate are both centered at the center Of' of the end plate. Thus, fabrication of the scroll fluid apparatus is facilitated by the feature that the outer peripheral edge 15m of the end plate and the arcuate wall surface 15d of the outermost peripheral groove are concentric with each other.

Figure 13:
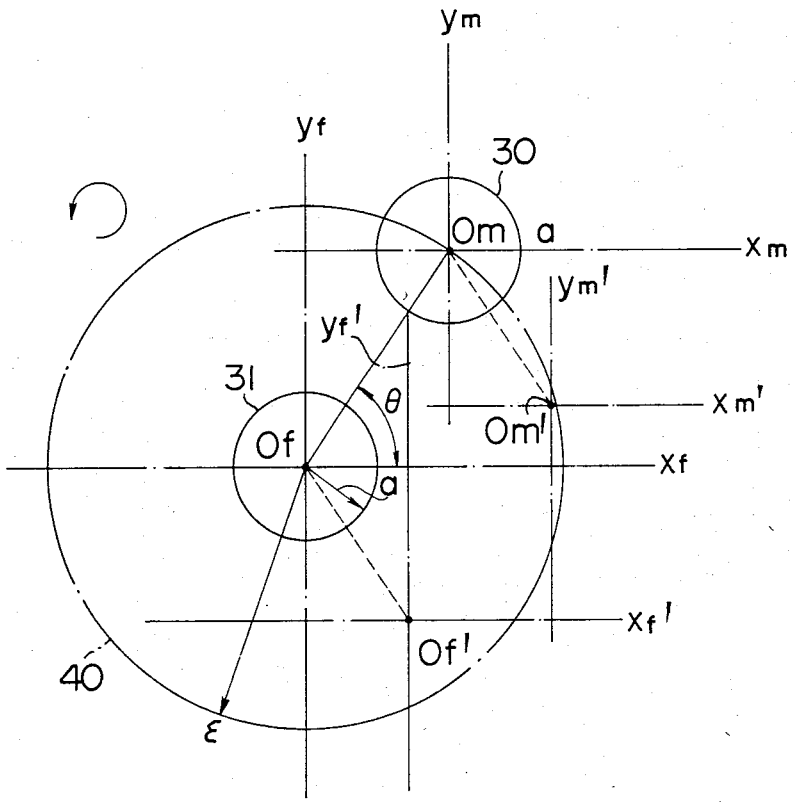
FIG. 13 is a fragmentary schematic view illustrating a relationship between the base circles of the spiral wraps of the orbiting and stationary scroll members and the axes of coordinates.

FIG. 13 clearly show the positional relation of the centers (coordinates) of the two scroll members 15 and 16 in operation. Of and Om are the centers of the base circles of the stationary and the orbiting scroll members 15 and 16 respectively. Of' and Om' are the centers of the end plates 15a and 16a respectively. The radii of the base circles 30 and 31 of the spiral wraps 15b and 16b are denoted by a. A rotation angle of the orbiting scroll member from the axis Xf is denoted by $\theta$. A circular path in which the orbiting scroll member 16 moves in obiting movement is designated by the numeral 40. Let the radius of the circular path 40 be denoted by $\epsilon$. Then the following relation is obtained:

$$OfOm=\epsilon \quad (10)$$

$$OfOf'=OmOm'=\pi a/2 \quad (11)$$

In the invention, the relation between the off-center distance ($\pi a/2$) and the radius ($\epsilon$) of the orbiting movement is subjected to no specific limitation.

Figure 14:
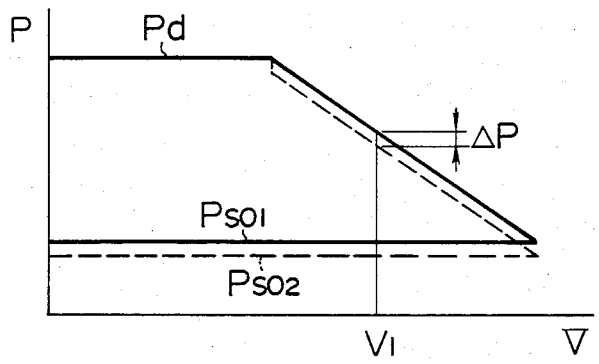
FIG. 14 is an indicator diagram derived from the compression mechanism shown in FIG. 1.
Figure 15:
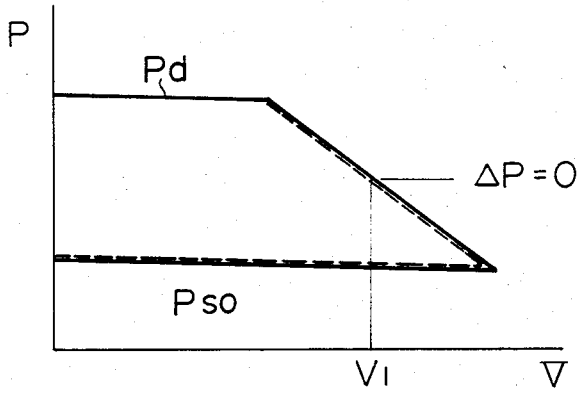
FIG. 15 is an indicator diagram derived from the compression mechanism according to the invention.

FIG. 14 is a diagram showing the relationship between the pressure P and the suction volume V obtained in the scroll compressor of the type shown in FIG. 1, with FIG. 15 being a diagram showing the relationship between the pressure P and the suction volume V obtained in the scroll compressor comprising the embodiment of the invention.

In FIG. 14, two sets of curves are drawn, because the suction passages 33a and 33b differ from each other in the loss of pressure due to a difference in the area and the respective pressures become $P_{so1}$ and $P_{so2}$ immediately before compression, compression is started from these different pressure levels. A rise in pressure in the compression spaces 5a and 5b is indicated by a solid line and a broken line respectively, with the discharge pressure being denoted by Pd. Under these conditions, a pressure difference ($\Delta P$, for example, at a certain volume $V_1$) would be produced between the compression chambers 5a and 5b and leaks would take place between them, thereby increasing the power equired for operating the compressor giving rise to the problem that the performance of the scroll compressor would be reduced.

On the other hand, in the embodiment of the invention shown in FIG. 15, the suction passages 33a and 33b have substantially the same loss of pressure because they are substantially of the same area as described hereinabove. Thus, the pressure prevailing in the suction spaces immediately before compression is $P_{so}$ and compression is started from this pressure level. Thus, the indicator diagram has only one set of lines and there is no pressue difference between the two compression chambers. This is conducive to no leaks between the compression chambers and to increased compression efficiency.

What is claimed is:

1. A scroll fluid apparatus comprising:

a stationary scroll member including a disc-shaped end plate and a wrap of a spiral form disposed in upright position on the end plate and having a suction chamber formed by an arcuate wall at an outer peripheral portion of the wrap; and an orbiting scroll member including a disc-shaped end plate and a wrap of a spiral form disposed in upright position on the end plate;

the stationary scroll member and the orbiting scroll member being assembled with the wraps facing inwardly and meshing with each other so as to allow the orbiting scroll member to move in orbiting movement with respect to the stationary scroll member without rotating on its own axis, the stationary scroll member being formed with an exhaust port opening in a central portion of the end plate and a suction port opening at its outer peripheral portion so that gas is drawn by suction through the suction port and compressed in compression spaces defined by the two scroll members and shifting the position toward the centers of the end plates to have the volume reduced to thereby discharge compressed gas through the exhaust port;

the orbiting scroll member and the stationary scroll member have the centers of their disc-shaped end plates displaced from the centers of base circles of the respective spiral wraps toward outer end edge portions of the wraps by $\pi a/2$, where $\pi$ is the ratio of the circumference of a circle to its diameter and a is the radius of the base circles of the spiral wraps.

2. A scroll fluid apparatus as claimed in claim 1, wherein the radial length of the end plate of the orbiting scroll member from the outer end edge portion of the spiral wrap to an outer peripheral edge of the end plate is equal to the radial length from an outer side wall of the wrap located circumferentially spaced apart from the outer end edge portion of the spiral wrap for an extent of substantially 180 degrees of the wrap winding angle to the outer peripheral edge of the end plate.

3. A scroll fluid apparatus as claimed in claim 1, wherein the center of the end plate of the orbiting scroll member is in alignment with the center axis of a bearing boss.

4. A scroll fluid apparatus as claimed in claim 1, wherein said arcuate wall forming said suction chamber of the stationary scroll member is a side wall concentrically centered at the center of the end plate of the stationary scroll member.

5. A scroll fluid apparatus as claimed in claim 4, wherein said side wall forming said suction chamber of the stationary scroll member extends from the outer end edge portion of the spiral wrap to a portion located circumferencially spaced apart from the outer end edge portion of the spiral wrap for an extent of 180 degrees of the wrap winding angle.

6. A scroll fluid apparatus comprising:

a scroll compressor and an electric motor accommodated in a sealed container such that the scroll compressor is located in an upper portion and the electric motor is located in a lower portion of the sealed container, the scroll compressor comprising:

a stationary scroll member including a disc-shaped end plate and a spiral wrap disposed in upright position on said end plate, said end plate having an outer peripheral portion thereof formed with an outer peripheral wall enclosing said spiral wrap, an arcuate wall forming a suction chamber and occupying substantially one half of said outer peripheral wall;

an orbiting scroll member including a disc-shaped end plate and a spiral wrap disposed in upright position on said end plate;

said stationary scroll member and said orbiting scroll member are assembled with the spiral wraps facing inwardly and in meshing engagement with each other while the orbiting scroll member is interposed between the stationary scroll member and a frame for orbiting movement with respect to the stationary scroll member without rotating on its own axis, said stationary scroll member being formed with an exhaust port opening in its central portion and a suction port opening at its outer peripheral portion;

the orbiting scroll member and the stationary scroll member have the centers of their disc-shaped end plates displaced from the centers of base circles of the respective spiral wraps toward outer end edge portions of the wraps by $\pi a/2$, where $\pi$ is the ratio of the circumference of a circle to its diameter and a is the radius of the base circles of the spiral wraps.

7. A scroll fluid apparatus as claimed in claim 6, wherein the radial length of the end plate of the orbiting scroll member from the outer end edge portion of the spiral wrap to an outer peripheral edge of the end plate is equal to the radial length from an outer side wall of the wrap located circumferentially spaced apart from the outer end edge portion of the spiral wrap for an extent of substantially 180 degrees of the wrap winding angle to the outer peripheral edge of the end plate.

8. A fluid scroll apparatus as claimed in claim 6, wherein the center of the end plate of the orbiting scroll member is in alignment with the center axis of a bearing boss.

9. A scroll fluid apparatus as claimed in claim 6, wherein said arcuate wall forming said suction chamber of the stationary scroll member is a side wall concentrically centered at the center of the end plate of the stationary scroll member.

10. A scroll fluid apparatus as claimed in claim 9, wherein said side wall forming said suction chamber of the stationary scroll member extends from the outer end edge portion of the spiral wrap to a portion located circumferentially spaced apart from the outer end edge portion of the spiral wrap for an extent of 180 degrees of the wrap winding angle.

* * * * *

UNITED STATES PATENT AND TRADEMARK OFFICE

CERTIFICATE OF CORRECTION

PATENT NO. : 4,494,914

DATED : January 22, 1985

INVENTOR(S) : Masao Shiibayashi

It is certified that error appears in the above-identified patent and that said Letters Patent is hereby corrected as shown below:

On the title page add:

| | | |
|---|---|---|
| Japan | 57-55435 | April 5, 1982 |

Signed and Sealed this

*Sixth* Day of *August 1985*

[SEAL]

*Attest:*

DONALD J. QUIGG

*Attesting Officer*

*Acting Commissioner of Patents and Trademarks*